US005133463A

United States Patent [19]

Merl

[11] Patent Number: 5,133,463

[45] Date of Patent: Jul. 28, 1992

[54] FASTENING ARRANGEMENT AND METHOD FOR WIRE MESH PANELS

[75] Inventor: Milton Merl, New York, N.Y.

[73] Assignee: Marlboro Marketing Inc., New York, N.Y.

[21] Appl. No.: 569,561

[22] Filed: Aug. 20, 1990

[51] Int. Cl.[5] ..... A07F 5/00

[52] U.S. Cl. ..... 211/190; 211/175; 211/181; 211/153

[58] Field of Search ..... 211/181, 175, 106, 86, 211/90, 134, 153; 108/102, 137

[56] References Cited

U.S. PATENT DOCUMENTS 2,956,689 10/1960 Van Der Togt ..... 211/106 X
4,437,572 3/1984 Hoffman ..... 211/184 X
4,602,570 7/1986 Lee ..... 211/181 X
4,646,658 3/1987 Lee ..... 211/184 X
4,776,472 10/1988 Rosen ..... 211/175 X

*Primary Examiner*—Robert W. Gibson, Jr.
*Attorney, Agent, or Firm*—Darby & Darby

[57] ABSTRACT

Adjustability in fastening is afforded by hooks extending from a periphery of wiremesh panels that is engageable simultaneously with any one of a plurality of parallel support rods which extend across another wiremesh panel so that both panels may rest against each other. Adjustability in fastening is also afforded by three elements which may be fastened together into a plurality of positions relative each other and which has one element secured to a support post of a gondola and another element supporting a lever system for a storage bin or for a shelf bin. Elongated slots in each of the three elements provide adjustability.

11 Claims, 2 Drawing Sheets

FASTENING ARRANGEMENT AND METHOD FOR WIRE MESH PANELS

BACKGROUND OF THE INVENTION

The present invention relates to a fastening arrangement for releasably interlocking wiremesh panels or frames.

Storage bins and bin shelves may be in the form of interlocked wiremesh panels or frames. Each wiremesh frame is preformed into a particular shape which, when interlocked with other preformed frames in a predetermined manner, provide a desired configuration for the bin or shelf. By wiremesh, the configuration is characterized by a set of parallel elongated elements which cross another set of parallel elongated elements to form a grid-like configuration. All the elongated elements of one frame are bounded by the periphery of the frame. The wiremesh may be made of any material, such as metal for durability and strength, synthetic resin for ease of manufacture, rubber or elastic materials for flexibility.

Depending upon the desired quantity of a product which is to held by the bin or shelf, it may be desireable to adjust the size of the bin or shelf accordingly. Where fastening between frames is effected solely at the periphery of the frames, adjustability in size may be impossible to obtain without deforming the frames.

Once assembled, the storage bins or bin shelves are secured to a gondola, which is an island fixture in retail or department stores used to display merchandise. The gondola is characterized by having two spaced apart and parallel vertically extending support posts, each with a plurality of holes at uniform distances along the height of the support post. These holes are suitable for attachment by hooks or the like which clamp into the holes.

Unfortunately, the spacing between the supports of the gondolas may vary depending upon the locale. Even if all the gondolas of a particular country are of a standard size, that standard size may still be different than that used in another country. Therefore, installing the same size bin or shelf in different countries poses problems.

It would therefore be desireable to provide a fastening arrangement between wiremesh frames which enables interengaging frames to be adjusted into any one of a plurality of relative positions. It would furthermore be desirable to provide a fastening arrangement to a gondola which is adjustable to accommodate variations in spacing between two vertical attachment supports of the gondola. In this manner, the same storage bin or bin shelf may be employed at different locations.

SUMMARY OF THE INVENTION

The present invention is directed to a fastening arrangement and method which includes two panels or frames each having a periphery bounding a plurality of elongated members which cross each other. The frames are adjustably engaged with each other into any one of a plurality of positions relative to each other. There are a plurality of engaging members which extend from the first frame and simultaneously and releasably engage with any one of a plurality of the elongated members of the second frame so that a plurality of said elongated members of said first frame are in contact with a plurality of said elongated members of said second frame.

Preferably, the engaging members are hooks with C-shaped portions which simultaneously accommodate one of the elongated members of the other frame.

The invention also relates to a fastening arrangement and method which includes two elongated support elements extending parallel to each other at the same elevation with respect to a gondola. At least one of the elongated support elements is adjustably secured to a respective support post of the gondola via two securing elements. The two securing elements are adjustably fastened to each other as well as respectively to the elongated support element and support post. This adjustability enables the securing elements to be arranged into any one of a plurality of relative positions.

For added adjustability and uniformity of component manufacture, it is preferred that both elongated support elements be secured to respective support posts in the same manner. The adjustability is enabled by the use of elongated slots in the securing elements and, preferably, also in the elongated support elements. The elongated slots of one element extends in a direction which is perpendicular or at least different from the direction in which elongated slots extend in another element.

For instance, the securing elements are arranged with one face with elongated slots against each other. The elongated slots of one face are elongated in a direction perpendicular to that of the other face and a fastening element such as a fastening screw is inserted through one elongated slot in each face. Adjustability is derived from the ability of the faces to be moved relative to each other into a plurality of positions prior to fastening along the length of the elongated slots. A nut is screwed onto the end of the fastening screw to secure the two faces against each other between the nut and head of the fastening screw.

Preferably, the elongated slots in the elongated support element extend at an angle which is oblique to the direction of elongation of the elongated support element. This angle may be 45°.

The invention also relates to a fastening arrangement and method in which two elongated members have clamping hooks for releasable securement to respective support posts of the gondola. Two prongs are adjustably and slidably inserted into two tubes. The prongs are attached to the side of one of the shelf bin and elongated members and the tubes are attached to the other of the shelf bin and elongated members. Since the elongated members are clamped onto the support posts, fastening adjustment between the shelf bin and support posts is effected by varying the amount in which the prongs are inserted into the tubes. The tubes and prongs are at the same elevation and to avoid allowing the prongs to fall out of the tubes due to gravity. They may be friction fit with each other so that they are not easily pulled apart from each other.

For a better understanding of the present invention, reference is made to the following description and accompanying drawings while the scope of the invention will be pointed out in the appended claims.

DESCRIPTION OF THE PREFERRED EMBODIMENT

Figure 1:
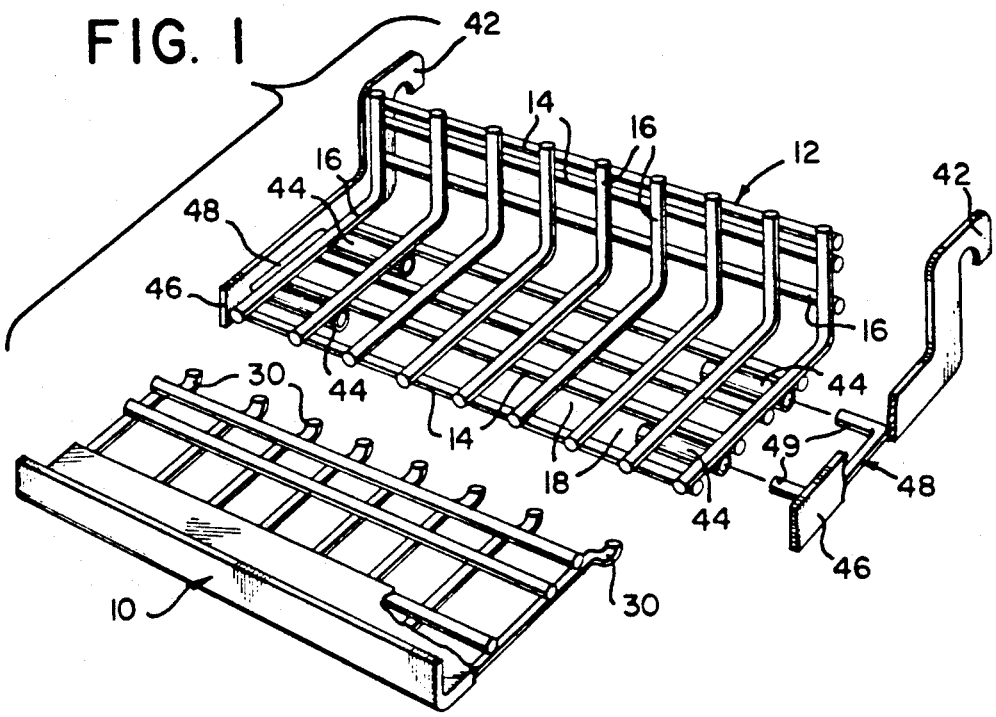
FIG. 1 is a perspective view of an unassembled shelf bin which has the fastening arrangement in accordance with a first embodiment of the present invention.
Figure 3:
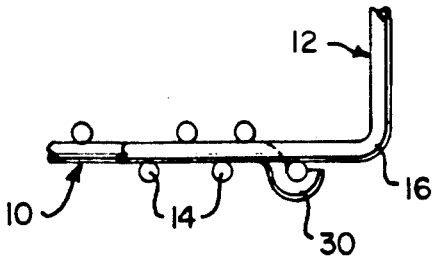
FIG. 3 is a side view as in FIG. 2 after fastening.
Figure 2:
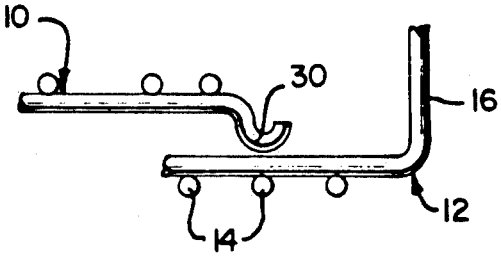
FIG. 2 is a partial side view of FIG. 1 prior to fastening.

FIG. 1 shows a perspective view of a shelf bin, in accordance with the present invention. The bin is configured to hold a large quantity of commercial products.

Panel or frame 10 is fastened to an adjacent panel or frame 12 by means of hook members 30, which have a C-shape and extend outward from a periphery of the panel 10. Any one of the parallel support rods 14 may be supported by the C-shape of each of the hook members 30 of panel 10 simultaneously.

Openings 18 are formed by the crossing of the parallel support rods 14 with parallel support rods 16. The hook members 30 are inserted from one side of panel 12 through respective openings 18 to the other side of panel 12. Then hook members 30 are positioned around one-half of one of the parallel support rods 16. After the hook members 30 are in place, the panel 10 are in contact against adjacent panel 12. Where one panel is over the other, the top one will be resting on the bottom one. The grid pattern of crossing parallel support rods (or at least the periphery) of one panel will be against the grid pattern (or at least the periphery) of the other panel. The panels extend parallel to each other while hooked or engaged together.

Adjustability in the size of the shelf bin is therefore afforded by selecting the parallel support rod to which fastening is to be effected.

Figure 5:
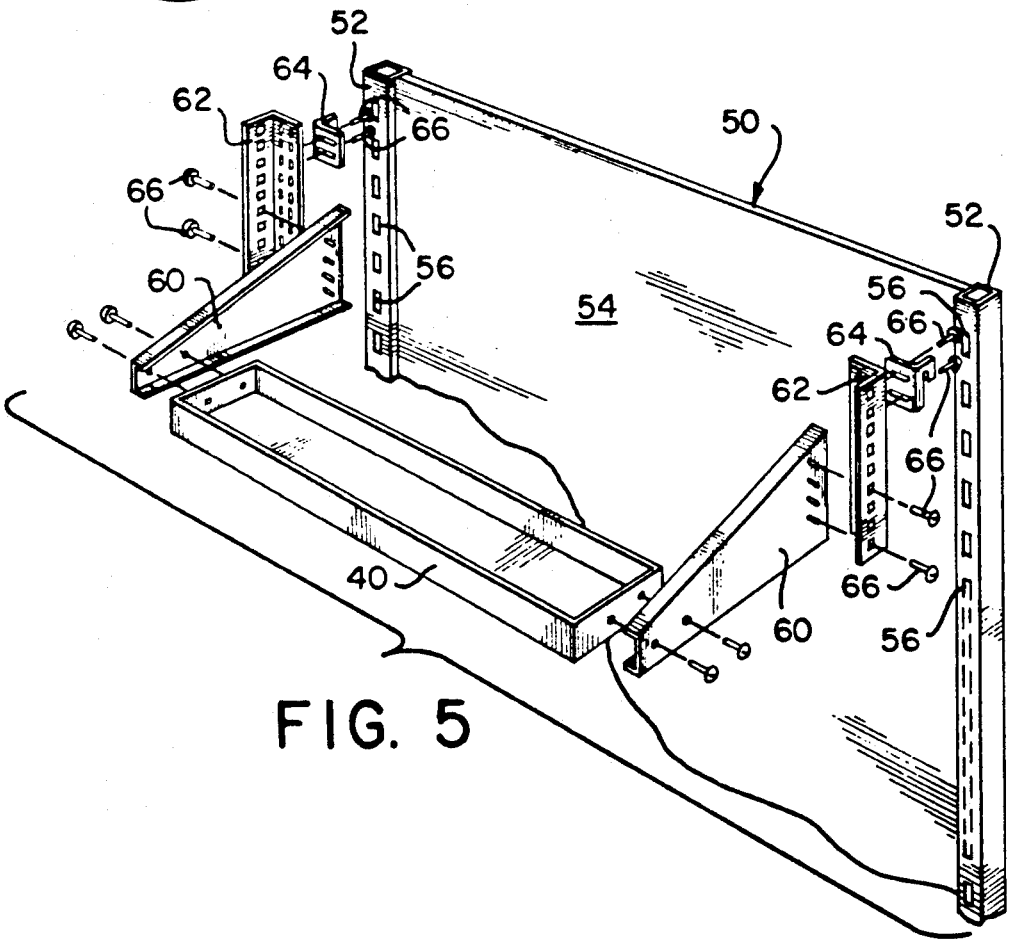
FIG. 5 is a perspective top view of the fastening arrangement of FIG. 4 in position for assembly onto a gondola to support a shelf bin or storage bin therebetween.

FIG. 5 shows a gondola 50, which is a support wall from which a holder 40 of products such as the shelf bin of FIG. 1, a storage bin, etc. may be supported. The gondola is characterized by two support posts 52 and a wall 54 held between the posts. The posts 52 are made from metal such as steel and have a series of vertically spaced apart holes 56 in a front side spaced apart at least along a portion of the length, if not the full length of the posts. The holes in each post are aligned with each other at the same elevation.

The tubes 44 open facing outward to the side of the shelf bin. A fastening element 48, which may be U-shaped, is secured to a support element 46 by welding or adhesive so that its prongs 49 point out to the side of the support element for slidable insertion into tubes 44. Clamping hook 42 of the support element 46 is placed into and held by one of the holes 56 of the gondola 50. The extent to which the prongs 49 of the fastening element 48 may be inserted into the tubes 44 determines the extent to which adjustability is afforded by the fastening arrangement between support posts 52.

Variation in distance between support posts of a gondola is not expected to exceed a few centimeters when used at one location as opposed to another so that this prong/tube adjustability feature may handle any such variation without mishap. Since the clamping hooks 42 are fastened to the support posts 50 and the tubes and prongs are level with each other, there is no real danger that the prongs will fall out of the tubes on their own. By limiting the amount of clearance between the inner wall of the tubes and the prongs, the prongs may be friction fit into the tubes so as to make it less likely they may be pulled apart inadvertently.

A storage bin or shelf bin is secured to a gondola 50 by means of support elements 46, tube 44 and fastening element 48 (see FIG. 1).

Figure 4:
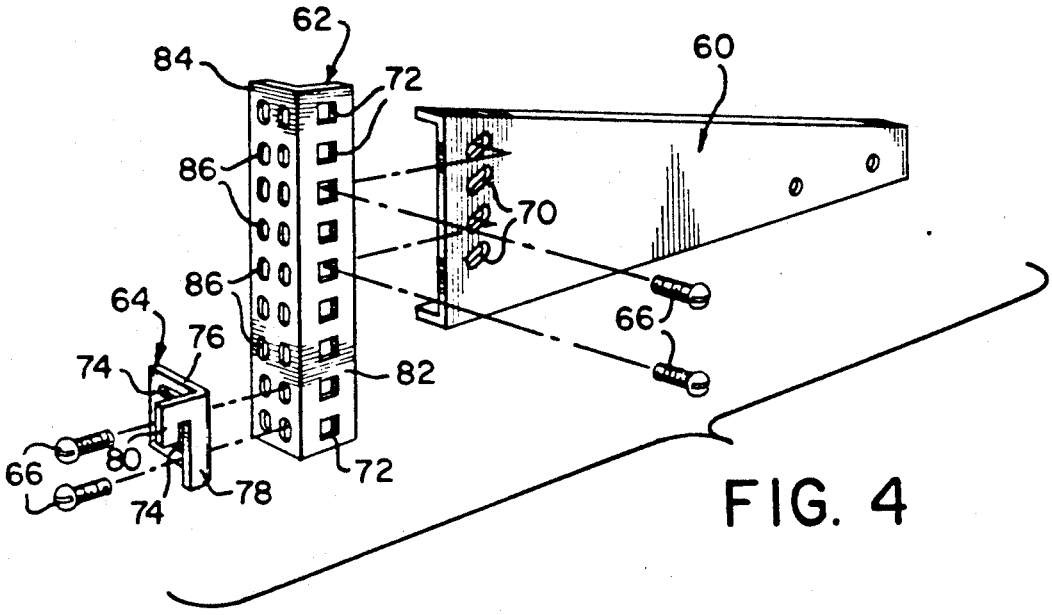
FIG. 4 is a perspective side view of the fastening arrangement prior to assembly in accordance with a second embodiment.

FIG. 4 shows a suitable arrangement of another adjustable fastening arrangement which may accommodate variations in distance between the support posts of a gondola as may arise in different locations. The fastening arrangement includes a support element 60, intermediate element 62, securing element 64 and two sets of a pair of fastening screws 66. The support element 60 may be any shape such as in the shape of supports 46, but without the clamping hooks because the securing elements 64 are provided with them. Thus, support element 60 may also have added adjustability by further providing for the fastening element 48 with prongs 49 which are inserted into tubes 44 of the shelf bin.

The support element 60 has a series of elongated slots 70 spaced apart from each other by a uniform distance, Each of these slots 70 preferably extend at an oblique angle such as 45° relative to the direction of elongation of the support element 60. These slots 70 are near one end of the support element 60 which is closer to the gondola than is the other opposite end of the support element 60.

The intermediate element 62 has one side 82 with a series of square openings 72, each spaced apart from each other by a distance which is the same as the uniform distance between slots 70. The intermediate element 62 also has another side 84, which is perpendicular to the other side 82 and which has a set of pairs of elongated slots 86. Each pair of slots is separated from another pair of slots in succession by another uniform distance in the direction of elongation of the intermediate element.

The securing element 64 has a portion 76 with two elongated slots 74 which are elongated in a direction which is perpendicular to that of the elongated slots 86 of the intermediate element 62 when the two elements are brought together as in FIG. 6. Another portion 78 extends perpendicularly from the other portion and has a hook 80. The hook 80 is placed into any of the holes 56 in the support posts 52 and supported by the lower edge which defines the respective hole.

Preferably, two fastening screws 66 are inserted through holes or slots in the intermediate element 62 to aligned slots in each of the support element 60 and securing element 64 in the manner evident from FIG. 6. Nuts (not shown) are screwed onto the end of the fastening screws to keep the screws from falling out of the holes or slots.

The employment of slots enable adjustability between the support posts 52 by allowing the relative attachment location between the support element 60, intermediate element 62 and securing element 64 to vary as desired by the length of the slots.

Of course, it should be evident that features of one element which engage with features on another element are inter-changeable with each other. Also, like features of one element are interchangeable with like elements on another, for example, elongated slots 74, 86 may be interchanged. Further, each of the adjustable fastening techniques of each embodiment may be combined together.

While it is preferable for hook members 30 to be fixed to one of the frames permanently, e.g., formed with it, the hook members may also be releasably fastened to the frame by elastically clamping onto the periphery of the frame.

While the foregoing description and drawings represent the preferred embodiments of the present invention, it will be understood that various changes and modifications may be made without departing from the spirit and scope of the present invention.

What is claimed is:

1. A fastening arrangement for frames, comprising:

a first and second frames each having a periphery bounding a plurality of elongated members which cross each other; and adjustment means for adjustably engaging said first and second frames together into any one of a plurality of positions relative to each other, said adjustment means including a plurality of engaging members extending from said first frame, said engaging members simultaneously and releasibly engaging with a selectable one of said plurality of elongated members of said second frame, each of said frames being in contact with the other of said frames when said frames are engaged.

2. An arrangement as in claim 1, wherein said engaging members include a plurality of hook members each having a C-shaped portion into which is accommodated a selected one of said plurality of elongated members of said second frame, when said frames are engaged.

3. A fastening arrangement for frames, comprising:

a first and second frames each having a periphery bounding a plurality of elongated members which cross each other; and adjustment means for adjustably engaging said first and second frames together into any one of a plurality of positions relative to each other, said adjustment means including a plurality of engaging members extending from said first frame, said engaging means simultaneously and releasably engaging with a selectable one of said plurality of elongated members of said second frame, each of said frames being in contact with the other of said frames when said frames are engaged, wherein said elongated members of said first and second frames extend in respective planes, said respective planes being parallel to each other.

4. An arrangement as in claim 3, wherein at least one of said first and second frames has an end portion which is angled from said respective planes so that said first and second frames constitute a shelf bin when engaged with each other.

5. A fastening arrangement for frames, comprising:

a first frame, said first frame including a first plurality of elongated members crossing each other, and a first peripheral member connected to said elongated members to fixedly position said elongated members relative to each other and to define the contour of said first frame, said first frame having a first generally planar segment including at least a portion of said first plurality of elongated members;

a second frame, said second frame including a second plurality of elongated members crossing each other, and a second peripheral member connected to said elongated members to fixedly position said elongated members relative to each other and to define the contour of said second frame, said second frame having a second generally planar segment including at least a portion of said second plurality of elongated members;

adjustment means for releasibly connecting said first frame to said second frame in any one of plurality of positions relative to each other, said adjustment means including a plurality of engaging members extending from said first frame generally in the plane of said first planar segment, said engaging means simultaneously and releasibly engaging with a selectable one of said second plurality of elongated members of said second frame, each of said frames being in contact with the other said frame when said frames are engaged.

6. A fastening arrangement as in claim 5, wherein said engaging members include a plurality of hook members each having a C-shaped portion into which is accommodated a selected one of said plurality of elongated members of said second frame when said frames are engaged.

7. A fastening arrangement for frames as in claim 5, wherein said first planar segment of said first frame is parallel to said second planar segment of second frame when said frames are engaged.

8. A fastening arrangement as in claim 2, wherein engagement of said first frame to said second frame provides a combined extended planar surface, the area of said extended planar surface being variable by selection of different ones of said elongated members of said second frame for accomodation in said hook members.

9. A fastening arrangement for frames, comprising:

a first frame, said first frame having a first generally planar segment;

a second frame, said second frame including a plurality of elongated members crossing each other, and a peripheral member connected to said elongated members to fixedly position said elongated members relative to each other and to define the contour of said second frame, said second frame having a second generally planar segment including at least a portion of said plurality of elongated members;

adjustment means for releasibly connecting said first frame to said second frame in any one of a plurality of positions relative to each other, said adjustment means including a plurality of engaging members extending generally in the plane of said first planar segment from said first frame, said engaging means simultaneously and releasibly engaging with a selectable one of said plurality of elongated members of said second frame, each of said frame being in contact with the other said frame when said frames are engaged.

10. A fastening arrangement as in claim 9, wherein said engaging members include a plurality of hook members each having a C-shaped portion into which is accommodated a selected one of said plurality of elongated members of said second frame when said frames are engaged.

11. A fastening arrangement for frames as in claim 9, wherein said first planar segment of said first frame is parallel to said second planar segment of second frame when said frames are engaged.

* * * * *